United States Patent [19]

Cole

[11] 4,241,906

[45] Dec. 30, 1980

[54] SKI VISE

[76] Inventor: Duane S. Cole, 1941 Walters Ct., Fairfield, Calif. 94533

[21] Appl. No.: 93,755

[22] Filed: Nov. 13, 1979

[51] Int. Cl.[3] ..... B25B 1/20

[52] U.S. Cl. ..... 269/43; 269/99; 269/153; 269/167; 269/906

[58] Field of Search ..... 269/43, 99, 152–154, 269/166–170, 321 W

[56] References Cited

U.S. PATENT DOCUMENTS

| | | | |
|---|---|---|---|
| 1,020,129 | 3/1912 | Crandal | 269/170 |
| 2,612,805 | 10/1952 | Heinrich | 269/167 |
| 2,846,907 | 8/1958 | Sprink | 269/167 |
| 3,861,664 | 1/1975 | Durkee | 269/43 |
| 4,066,250 | 1/1978 | Campbell | 269/43 |

*Primary Examiner*—Robert C. Watson

*Attorney, Agent, or Firm*—Flehr, Hohbach, Test, Albritton & Herbert

[57] ABSTRACT

A vise to hold a pair of skis in either the flat or edge up positions employs two spaced base members, a pair of guide-ways and a clamping rod extending between the base members. A floating jaw slides along the guide-ways and a movable clamping jaw is side actuated to grip the clamping rod to hold the skis in a snug and firm condition.

3 Claims, 5 Drawing Figures

10
11
12
13
14
16
16
17
17
18
21
21
22
23
24
26
27
31
32
33
33
36
36
44
45
47
56
-2-
-2-

SKI VISE

This invention relates to ski clamping apparatus and particularly concerns a compact vise for holding one or a pair of snow skis in either of two positions for working on the skis.

There is a need for a quick acting, compact ski vise which a ski mechanic can set up on a narrow workbench. This requirement derives from space limitations in ski workshops located in either the retail stores or ski pro shops. The ski vises available are generally screw actuated to gain thecessary clamping force. This design results in a vise with a handle extending from one end for operating the clamping screw. Such an arrangement requires space immediately aft the operating handle which is an obstruction if the unit is mounted flush with the rear edge of the workbench. Another characteristic of some of the present ski clamping vises is a rocking motion found in certain constructions where a pair of skis are arranged in the flat position for holding between the jaws of the vice. See for example the construction of U.S. Pat. No. 4,066,250.

An object of this invention is to provide a quick acting compact ski vise for holding either one or two skis in a snug and firm condition so that the ski mechanic may perform the needed operations upon the skis.

Another object of the invention is to provide a ski vise of the type described which is capable of holding the skis in a stable condition but yet not injuring or marring the skis by reason of the clamping forces of the vise.

Another object of the invention is to provide a ski vise of the type described which has a substantially shorter overall length than prior ski vises enabling it to be mounted upon a narrow workbench.

In summary the invention includes a ski clamp or a ski vise apparatus having two spaced apart base members adapted to be secured to the surface of a workbench. A laterally spaced apart pair of guide ways extends between the base members and are fixedly secured thereto and a clamping rod is arranged between said base members extending parallel to said guide members. A floating jaw is slidably disposed on said clamping member and guide ways and a clamping jaw member is arranged on said guide ways and said clamping rod longitudinally of said floating jaw, said clamping member being equipped with means gripping said clamping rod and actuated from a handle disposed to one side of said vise to that the overall extent of said vise is defined by the ends of said two base members.

FIG. 1 of the drawings is a perspective view of the ski vise of the present invention showing in phantom lines portions of two skis operatively associated with the vise;

Figure 1:
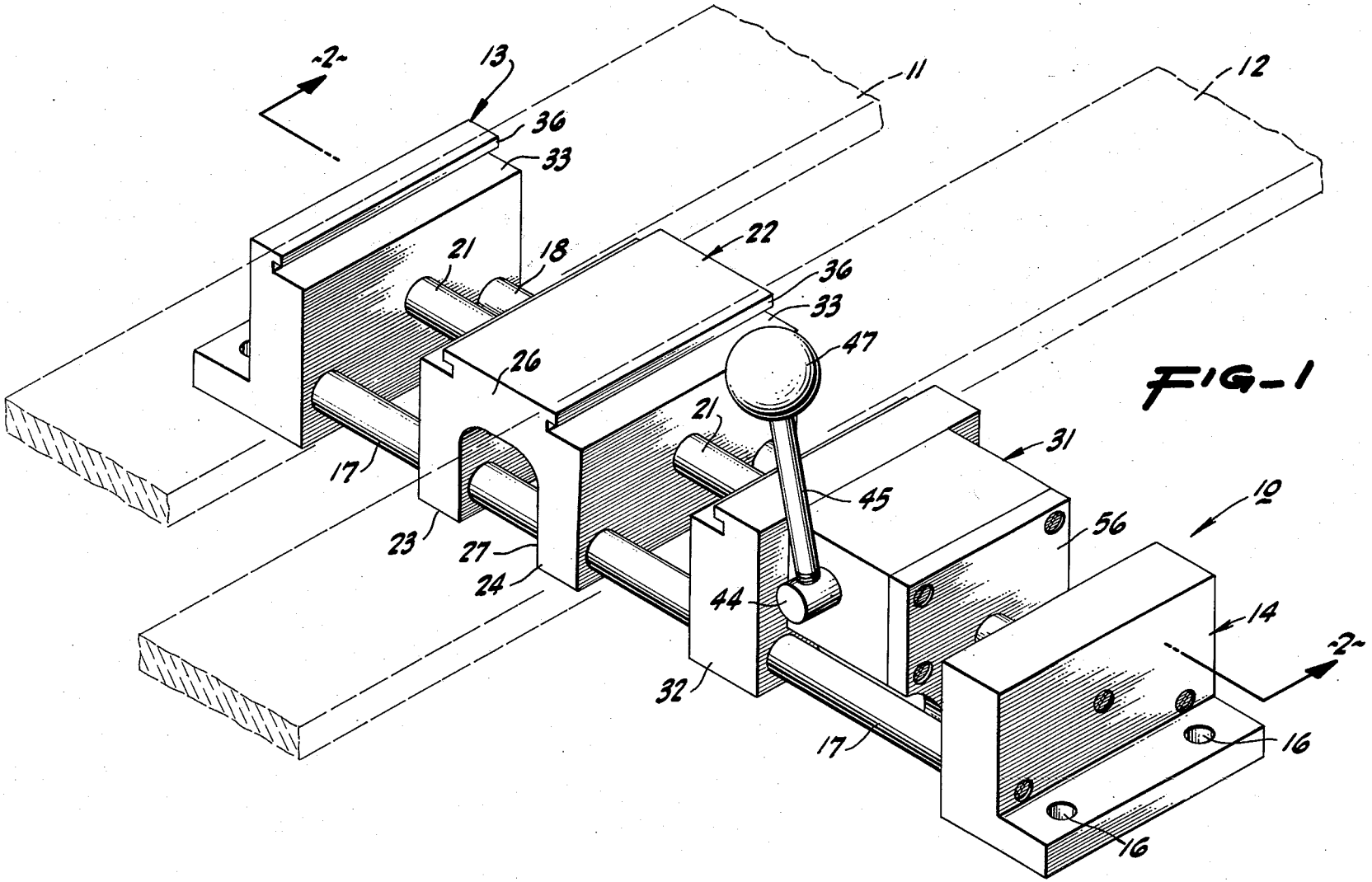
Figures 2, 3, 4, 5:
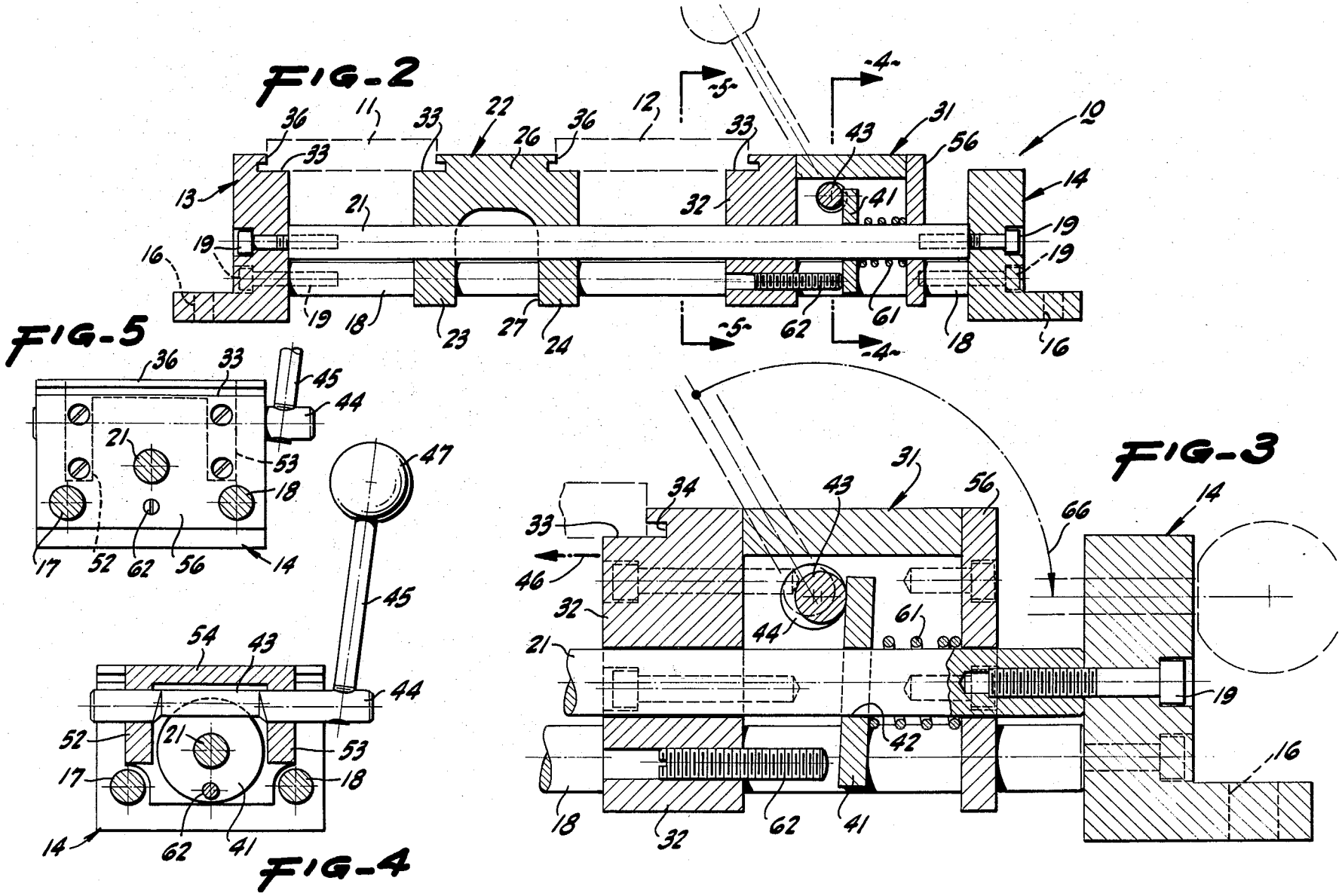
FIG. 2 is a section view in the direction of the arrows 2—2 of FIG. 1 but on a reduced scale.
FIG. 3 is an enlarged section view of the right end portion of FIG. 2.
FIG. 4 is a section view of the scale of FIG. 2 in the direction of the arrows 4—4 of FIG. 2.
FIG. 5 is a section view in the direction of the arrows 5—5 of FIG. 2.

A ski vise 10 of the present invention is shown in the drawings and in FIGS. 1 and 2 is shown associated with a pair of skis 11 and 12 illustrated in broken lines as disposed in the "flat" composition. The vise 10 is operative to hold a pair of skis in the vertical position (not shown) and may be used to hold only a single ski as will be apparent from the following description.

The overall length of the ski vise 10 is defined by the L-shaped base members 13 and 14 each of which is provided with fastener receiving hols 16 for securing the vise 10 firmly to a workbench (not shown). Extending between the base members 13, 14 are two ends to the base members by cap screws 19 so as to establish a rigid frame structure between the ways and base members.

A clamping rod 21 extends between the base members 13, 14 and is mounted in alignment with the ways but offset upwardly from the plane of the guide ways as shown in FIGS. 4 and 5. The clamping member 21 may be secured to the base members by the same construction used for the guide ways for ease of construction and smoothness of operation the guide ways and clamping rod may all be made of cylindrical metal stock.

A floating jaw 22 is slidably arranged with respect to the ways 17, 18 and clamping rod 21 and includes spaced walls 23 and 24 joined by a top wall 26, the vertical walls 23, 24 being provided with suitable openings for sliding action with respect to the members 17, 18 and 21 as shown in FIG. 2. The space between the walls 23, 24 is at least equal to twice the diameter of the ways 17, 18 to that the sliding jaw 22 engages the ways at 4 spaced apart locations which affords substantial stability of the jaw 22 in the clamping condition to be described below.

A clamping jaw assembly 31 is slidably disposed upon the guide ways 17, 18 and the clamping rod 21 and is disposed in the vise 10 adjacent to the base member 14 and the sliding jaw 22 as clearly shown in FIGS. 1 and 2. The clamping jaw assembly 31 includes a lateral wall 32 suitably apertured for sliding action with respect to the guide ways 17, 18 and clamping member 21. The upper portion of the wall 32, like the wall 26 of the floating jaw 22 and the top portion of the base member 13, is provided with a shoulder 33 which extends into a recess 34 which serves to receive the edges of a ski while the clamping action of the jaws when the skis are in the flat position and clamping contact is provided by the vertical nose surfaces 36 as shown in FIGS. 2 and 3.

A clamping mechanism is included in the clamping jaw assembly 31, the mechanism comprising a swash plate 41 having a central aperture 42 slightly larger than the diameter of the clamping rod 21, as shown best in FIG. 3. A cam 43 formed on a rod 44 extends laterally on the swash plate 41 and serves to tilt the plate 41 from a position perpendicular to the clamping rod 21, as shown in FIG. 2, to the clamping condition in FIG. 3. In the clamping condition as shown in FIG. 3 the forces between the clamping rod 21, the swash plate 41, the cam and rod 43 and 44 mounted on the clamping jaw assembly fixes the clamping jaw assembly firmly to the clamping rod member 21. The action of a cam 43 and swash plate 41 is such that the entire clamping jaw assembly 31 is urged in the direction of the arrow 46 FIG. 3 to bring clamping forces to bear upon the skis received on the vise 10.

The cam rod 44 is actuated with the side mounted handle 46 equipped with a spherical nob 47 for comfort to the operator's hands. The cam rod 44 extends from one side of a housing 51 which is rigid with the clamping jaw assembly 31 and includes side walls 52, 53, a top wall 54 (FIG. 4) and an end wall 56 (FIG. 2), the parts being bolted together and forming with the wall 32 a rigid box-like structure. Within the housing 51 a compression spring 61 reacts between the end wall 56 and the swash plate 41 serving to urge the swash plate towards the perpendicular position as shown in FIG. 2 and when the cam is released the spring 61 presses the swash plate 41 against a stop rod 62.

The operation of the vise 10 contemplates that both the clamping jaw assembly 31 and the floating jaw 22 are freely slidably on the guide ways 17, 18 and on the clamping rod 21 between the end members or abutments 13 and 14. Thus where it is necessary to hold only one ski in the vise 10 the clamping jaw assembly 31 is brought into abutment with the floating jaw 22 and the ski is placed on the shoulders 33 of the jaw 22 and the base member 13. On the other hand, where a pair of skis is to be accommodated in vise 10 the jaw members are positioned as shown in FIGS. 1 and 2 and clamping action of the swash plate against the clamping rod 21 is caused by shifting the handle 46 in the direction of the arrow 66, FIG. 3. Forces then are generated in the direction of the arrow 46 to clamp securely skis within the vise.

It will be recognized that the broad configuration of the nose surface 36 as well as the walls 23, 24 of the floating jaw afford snug holding of the skis without undue local pressures which could mar the sides of the ski. The position of the actuating handle 45 is laterally to one side of the vise 10 which makes possible an overall shorter length of the vise and keeps the handle in an out-of-the-way position when the unit is installed. Thus the extreme ends of the vise are defined by the end members 13 and 14, there being no extending actuating handle as found in prior art structures extending from one end of the vise.

One preferred embodiment of the present invention has been illustrated in the accompanying drawings and has been described above. However it is intended that the scope of this invention shall be limited only by the claims which follow.

What is claimed is:

1. A vise for holding a pair of skis in either the flat or the vertical position exposing the edges comprising spaced apart base members adapted to be fastened to a supporting surface, laterally spaced apart guide ways extending between said base members and fixedly secured thereto, a clamping rod extending between said base members, floating jaw means freely slidable along said ways and said clamping rod, clamping jaw means arranged for sliding movement along said ways and said clamping rod between one of said base members and said floating jaw means, said clamping jaw means including means gripping said clamping rod for fixing said clamping jaw means in a selected position, said gripping means serving to apply force in the direction of the other one of said base members, an actuator means coupled to said gripping means and disposed entirely to one side of said ski vise so that no portions of said ski vise extend beyond said base members.

2. The ski vise of claim 1 wherein each said floating jaw means, said clamping means and one of said base members are equipped with recesses serving to receive the edges of skis when the skis are received in said vise in the flat position.

3. The ski vise of claim 1 wherein said gripping means comprises a swash plate arranged on said clamping rod, cam means coupled to said actuator means serving to tilt said swash plate away from a position perpendicular to said clamping rod, and spring means serving to oppose said cam means serving to place said swash plate in the perpendicular condition upon disengagement therefrom of said cam means, of and stop means arranged opposite from said spring means arresting motion of said swash plate in the opposite direction.

* * * * *